US005879142A

United States Patent [19]

Kitagawa

[11] Patent Number: 5,879,142

[45] Date of Patent: Mar. 9, 1999

[54] FLUID TRANSFER SYSTEM AND BLOOD CELL COUNTER INCLUDING THE SAME SYSTEM

[75] Inventor: Nobuhiro Kitagawa, Kobe, Japan

[73] Assignee: Toa Medical Electronics Co., Ltd., Hyogo, Japan

[21] Appl. No.: 790,227

[22] Filed: Jan. 28, 1997

[51] Int. Cl.[6] ..... F04B 23/00

[52] U.S. Cl. ..... 417/440; 417/475; 417/477.1

[58] Field of Search ..... 417/440, 475, 417/477.1

[56] References Cited

U.S. PATENT DOCUMENTS 3,819,303 6/1974 Pfleger ..... 417/440

4,834,630 5/1989 Godwin ..... 417/475

5,052,900 10/1991 Austin ..... 417/440

5,674,058 10/1997 Matsuda et al. ..... 417/440

*Primary Examiner*—Charles G. Freay

[57] ABSTRACT

A fluid transfer system employing a roller pump for squeezing an elastically deformable tube by a roller to allow fluid to be transferred from a transfer source to a transfer destination, said fluid transfer system being characterized by comprising: a short-cut passageway connecting between an inlet passageway and an outlet passageway of said tube fitted onto said roller pump; and a passageway switching means for selectively bringing fluid into fluid communication with said short-cut passageway.

8 Claims, 6 Drawing Sheets

FLUID TRANSFER SYSTEM AND BLOOD CELL COUNTER INCLUDING THE SAME SYSTEM

BACKGROUND OF THE INVENTION

1. Field of the Invention

This invention relates to a fluid transfer system, and more particularly to a fluid transfer system using a roller pump adapted for squeezing elastically deformable tubes so as to transfer fluid from a transfer source toward a transfer destination.

2. Description of the Related Art

Conventionally, there have been known fluid transfer systems employing a roller pump for the purposes of transferring liquids such as reagents and detergents or gases such as air. If such a system is provided with a plurality of roller pumps, the timing of transfer and the liquid amount thereof for tubes fitted on each pump can be controlled, pump by pump, by driving and stopping the pumps.

In the abovementioned conventional fluid transfer system, if a plurality of fluid transfers are to be individually controlled, there is a necessity of installing a plurality of roller pumps, resulting in increase of cost in addition to large installation spaces.

Furthermore, if an individual fluid transfer is to be controlled by driving and stopping the pump, a certain period of time will be required for establishing stable supply from the starting of a pump-driving motor up to the beginning of fluid supply as well as a period of time for establishing complete termination from the stopping of the motor to the ending of the fluid supply, rendering it difficult to perform constant-amount transfer of liquid with accuracy and precision.

On the other hand, if a plurality of tubes are fitted to one roller, simultaneous fluid transfer to a plurality of sites is possible, but the timing of transfer and the amount of liquid transferred can not be controlled on an individual tube basis.

SUMMARY OF THE INVENTION

It is an object of the present invention to provide a fluid transfer system which is capable of performing constant-amount liquid transfer with accuracy and precision.

It is another object of the present invention to provide a fluid transfer system in which fluid transfer is controllable tube by tube, while fitting a plurality of tubes onto one roller pump.

In accordance with the present invention, there is provided a fluid transfer system employing a roller pump for squeezing an elastically deformable tube by a roller to cause fluid to be transferred from a transfer source to a transfer destination, the fluid transfer system comprising: a short-cut passageway provided between an inlet passageway of the tube fitted onto the roller pump and an outlet passageway thereof; and a passageway switching means for selectively bringing fluid into fluid communication with the short-cut passageway.

PREFERRED EMBODIMENTS OF THE INVENTION

Figure 1:
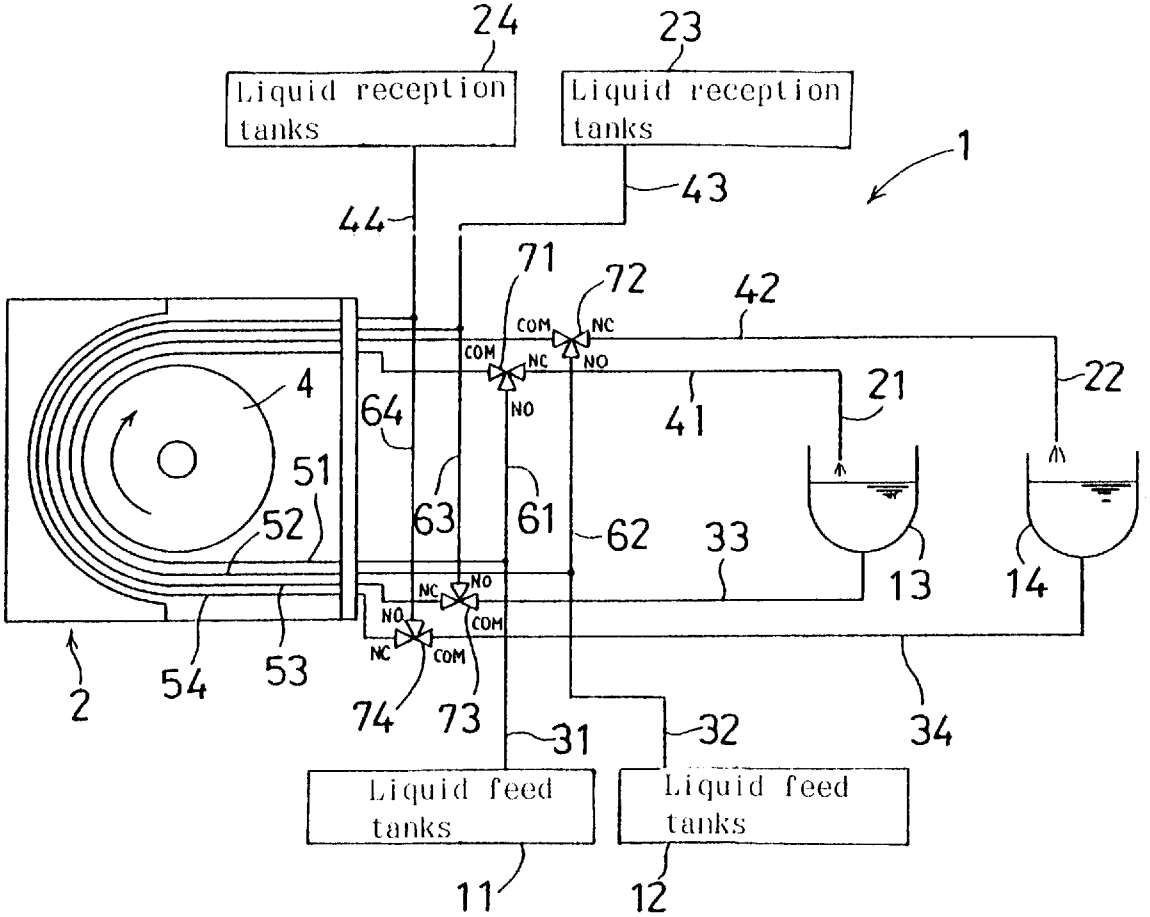
FIG. 1: A piping diagram of a fluid transfer system according to one embodiment of the present invention.

In the fluid transfer system, when the roller pump is driven, the tubes are squeezed by the rotation of the rollers so that the fluid in communication with the tube is introduced from a transfer source toward a transfer destination. On this occasion, if the passageway switching means is switched with the roller pump driven, the inlet and outlet passageways of the roller pump are brought into connection through a short-cut passageway, thereby forming a circulation passageway. The fluid is placed in circulation through the circulation passageway without being transferred to the transfer destination. If the fluid passageway is switched over by the passageway switching means, the fluid in communication with the tube is introduced from the transfer source toward the transfer destination.

Since the roller pump continues to rotate without stopping during the circulating period, stable supply or complete stoppage of fluid is immediately established responsive to the operation of the passageway switching means. It is therefore possible to suppress the delay in transferring the fluid or the excess/deficiency of the transfer amount to a minimum, as compared with cases where the roller pump is controlled for fluid transfer by driving and stopping the motor.

The fluid used in the present invention refers to liquids such as reagents, cleaning liquid, suspensions, or gases such as air and unspecified gases.

The tube of the present invention refers to a flexible tube which is elastically deformed due to squeezing action applied thereon by moving the roller attached to the roller pump, thereby providing fluid introduction toward the direction of squeezing due to pressure gradient created within the tube. It is preferred that the tube does not become deteriorated or degraded by the property of the liquid to be transferred, and further formed of a material possessing wear resistance. A silicone rubber, a natural rubber, or a polyurethane resin may, for example, be used as the material.

The squeezing operation by the movement of the roller involves rotation of the roller and straight-lined movement of the roller.

The inlet passageway of the present invention refers to a pipeline portion (transfer source side) under negative pressure extending in a direction opposite to that of roller squeezing with respect to the portion to which the roller squeeze is done, whereas the outlet passageway of the tube refers to a pipeline portion (transfer destination side) under positive pressure extending in the direction of roller squeezing with respect to the portion to which the roller squeeze is done.

The roller pump of the present invention refers to a pump which includes, for example, a motor shaft, a rotor attached for rotation about the motor shaft, and at least two rollers attached to peripheral portions of the rotor, wherein elastically deformable tubes are fixed in the vicinity of the outer periphery of the rotor so that the roller can press the tubes on the surfaces thereof, to allow rotation of the roller so as to squeeze the fixed tubes on the surface thereof, thereby forming pressure gradient within the tubes. Incidentally, there is a type of roller pump which presses tubes linearly in one direction straight line manner.

The short-cut passageway of the present invention refers to a passageway which communicates between the inlet passageway and the outlet passageway at front and rear sides of the portion of the tubes attached on the roller pump.

The passageway switching means refers to such a switch-controllable means that can selectively provide positions of a state in which fluid circulates from the outlet passageway through the short-cut passageway to the inlet passageway by opening the short-cut passageway and a state in which the fluid, introduced from the inlet passageway, flows passageway from the outlet passageway toward the transfer destination by closing the short-cut passageway.

The fluid transfer system is preferably structured so that a plurality of tubes are fitted onto one roller pump, each of the tubes has a short-cut passageway and a passageway switching means provided therein, and the passageway switching means are simultaneously or individually switchable. This makes it possible to perform simultaneous transfer of fluid to a plurality of transfer destinations with one roller pump, as well as control of the transfer timing and the amount of liquid to be transferred tube by tube. The plurality of tubes to be fitted may be of the same diameter or of different diameters. Although there is no limitation to the number of tubes to be fitted onto one roller pump, it is preferred to fit 4 to 6 tubes in view of the capacity and the size of the roller pump.

It is preferred that the passageway switching means is provided at a branch point between the short-cut passageway and either of an inlet passageway and an outlet passageway of the tube fitted onto the roller pump. Here, the passageway switching means preferably includes a three-way switching valve which is capable of assuming a state in which the fluid is allowed to return from the outlet passageway through the short-cut to the inlet passageway by openings the short-cut passageway and a state in which the fluid introduced into the inlet passageway is allowed to flow from the outlet passageway toward a transfer destination by closing the short-cut passageway. The employment of a three-way switching valve for the passageway switching means offers simplification in structure of piping including the switching means and in control of switching means.

The passageway switching means may preferably comprise two stop-valves, one being disposed in the short-cut passageway and the other being disposed in the inlet passageway closer to the transfer source relative to the branch point. Alternatively the passageway switching means may preferably comprise two stop-valves, one being disposed in the short-cut passageway and the other being disposed in the outlet passageway closer to the transfer destination relative to the branch point. With such structures, the timing of transfer and the amount of liquid transferred can be controlled tube by tube, by opening and closing one valve and closing and opening the other valve in accordance therewith.

It is preferred that the short-cut passageway is a vent flow passageway provided between the outlet passageway and a transfer destination, and the passageway switching means is a three-way switching valve provided at a branch point between the outlet passageway and the vent flow passageway.

The vent flow passageway of the present invention refers, for example, to a circulation passageway for allowing the fluid, which was transferred from the liquid feed tank (transfer source) to the inlet passageway/the outlet passageway of the tube to return to the liquid feed tank. With such an arrangement, the piping is simplified, a circulation passageway including the transfer source as part of the flow passageway is formed, and the circulation passageway can be formed as an open system, so that if the transfer source includes a reservoir or a tank (vessel), the fluid in the transfer source can be stirred by the circulation flow.

A blood cell counter in an example of an apparatus employing the fluid transfer system of the present invention. It is preferred that the blood cell counter has a reagent-supplying section, a counting section for preparing a sample to be measured by adding a reagent transferred from the reagent-supplying section to a blood sample to count blood cells in the sample to be measured, and a sample-discharging section for discharging the sample measured by the counting section, wherein the reagent-supplying section or the sample discharging section includes the fluid transfer system of the present invention.

FIG. 1 shows a fluid transfer system utilizing a roller pump according to one embodiment of the present invention. The fluid transfer system 1 comprises the combination of liquid feed tanks 11, 12 and chambers 13, 14 as sources of transfer, pipettes 21, 22 and liquid reception tanks 23, 24 as destinations of transfer, pipelines 31 to 34 respectively connected to the transfer sources 11 to 14, pipelines 41 to 44 respectively connected to the transfer destinations 21 to 24, short-cut pipelines 61 to 64 connected between the pipelines 31 to 34 and the pipelines 41 to 44, control valves 71 to 74 connected to ends of the short-cut pipelines 61 to 64, and one roller pump 2 equipped with tubes 51 to 54.

The tubes 51 to 54 are formed of silicone rubber so as not to be readily degraded by the liquid dispensed into the liquid feed tanks 11, 12 and the chambers 13, 14, and are mounted at their respective intermediate portions to the roller pump 2.

Figure 2:
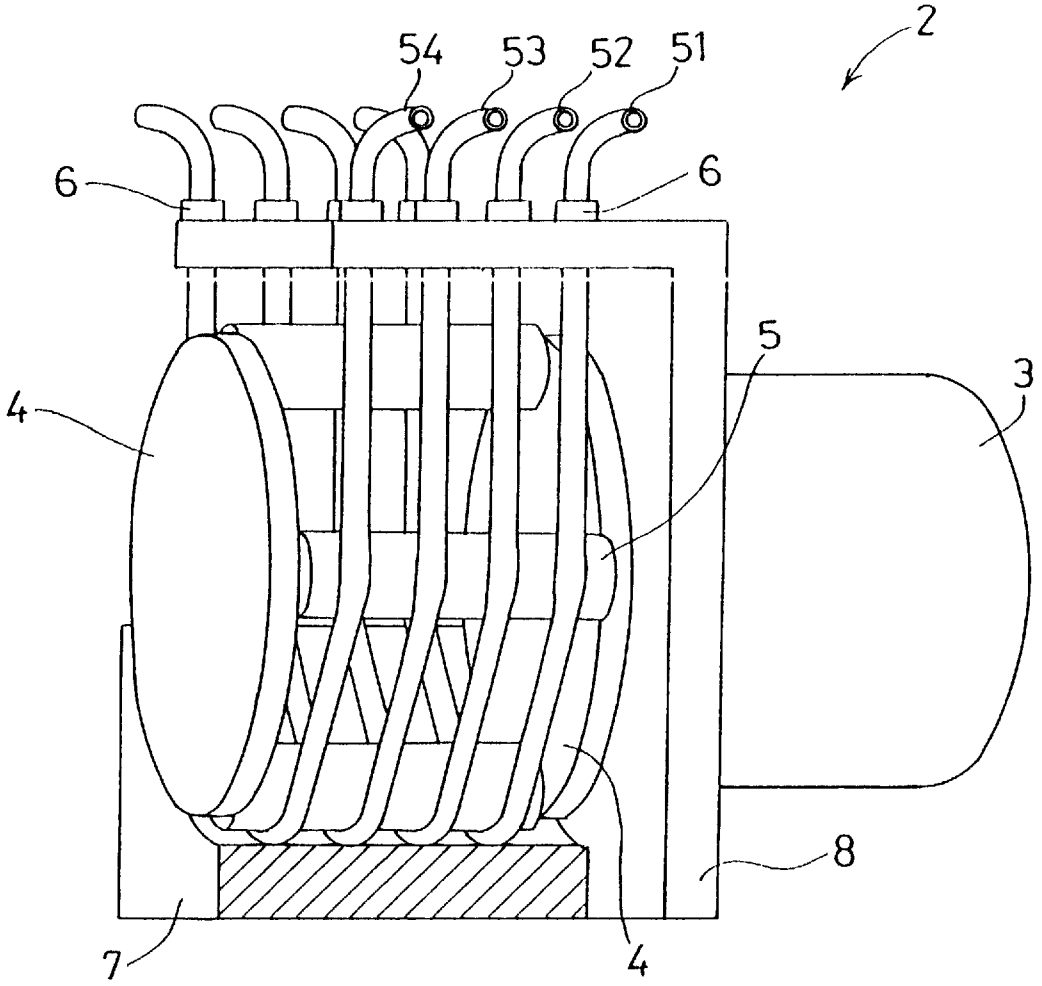
FIG. 2: A perspective view of a roller pump for the fluid transfer system of FIG. 1.

The roller pump 2, as shown in FIG. 2, comprises a motor 3 equipped with reduction gears, rotors 4 coupled to the motor shaft, a plurality of rollers 5 equidistantly arranged between the rotors 4, and a pump base 8 having tube stoppers 6 and a tube-pressing member 7 arranged therein. Each roller 5 is fixed to respective peripheral edge portions of the rotors 4, for its individual rotation. The tube stoppers 6 serve to prevent each of the tubes 51 to 54 from being shifted by the rotation of the rollers 5, by fixing one end of each of the tubes 51 to 54, to one of the tube stoppers 6, winding each of the tubes 51 around the rollers 5 with arbitrary tension on one hand and then fixing the other end of each of the tubes 51 to 54 to another of the tube stoppers 6.

The tube-pressing member 7 is detachably mounted so that each of the tubes 51 to 54 rest in a pressed state between the roller 5 and the tube-pressing member 7 after being wound around the rollers 5. The tube-pressing member 7 may be provided with guide grooves, not shown, corresponding to the outer diameter of each of the tubes 51 to 54 to be wound around the rollers 5.

On the other hand, the short-cut pipelines 61 to 64 are respectively connected to three-way valves 71 to 74 of electromagnetic switching type. The pipettes 21, 22 and the three-way valves 71 to 74 are electrically connected to a control section not shown.

The operation will be explained on a fluid transfer system involving four transfer lines.

Figure 3:
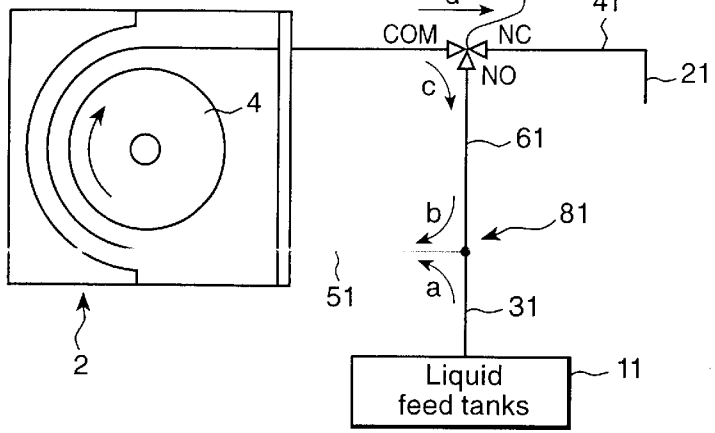
FIG. 3: A piping diagram for explaining one flow passageway system for the fluid transfer system of FIG. 1.

In FIG. 3, when the three-way valve 71 is in an "off" state, the liquid circulates in the directions of the arrow b and the arrow c through the three-way valve 71, the short-cut pipeline 61, the branch point 81, and the tube 51 by the driving force of the roller pump 2, so that no transfer is made to the pipeline 41 and the pipette 21. When the three-way valve 7 is switched over to an "on state", the liquid flows in the directions of the arrow a and the arrow d. That is, dispensing is made from the liquid feed tank 11 through the pipette 21 via the pipeline 31, the tube 51, and the pipeline 41.

Figure 4:
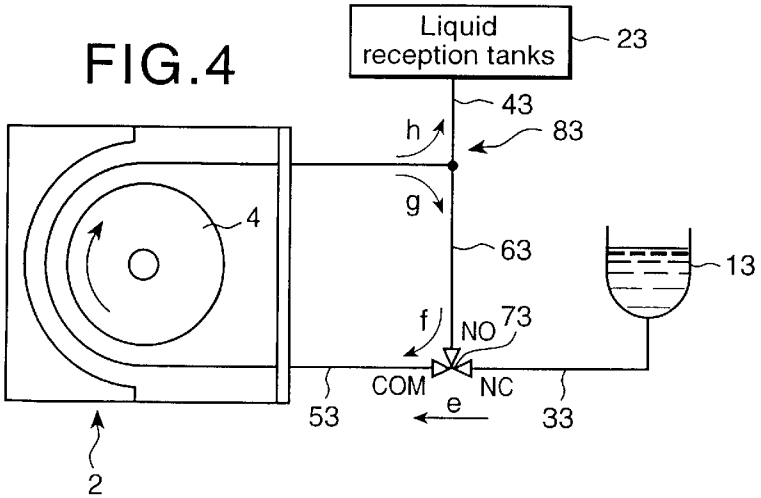
FIG. 4: A piping diagram for explaining another flow passageway system for the fluid transfer system of FIG. 1.

Similarly in FIG. 4, when the three-way valve 73 is in an "off state", the liquid circulates in the directions of the arrow g and the arrow f through the branch point 83, the short-cut pipeline 63, the three-way valve 73, and the tube 53, so that no transfer is made to the pipelines 43 or the liquid reception tank 23. When the three-way valve 73 is switched over to an "on state", liquid is transferred from the chamber 13 via the flow passageway 33, the tube 53, and the pipeline 43 and in the directions of the arrow e and the arrow h to the liquid reception tank 23.

Figure 5:
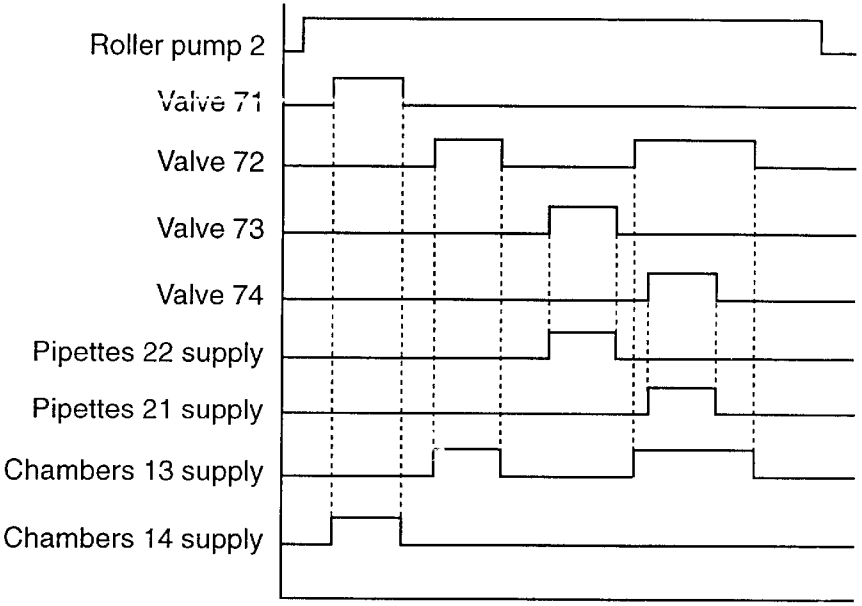
FIG. 5: A time chart showing the operation of various sections of the fluid transfer system of FIG. 1.

With the above stated two transfer units, it is possible to dispense liquid to the chamber 13 from the liquid feed tank 11 at predetermined timing and to further transfer the liquid from the chamber 13 to the liquid reception tank 23 at predetermined timing. Similarly, with other two transfer units in FIG. 1, it is possible to dispense liquid to the chamber 14 from the liquid feed tank 12 at predetermined timing and to further transfer the liquid to the liquid reception tank 24 at predetermined timing. One example of a time chart for the fluid transfer system having four transfer units incorporated therein is shown in FIG. 5.

In this manner, in the fluid transfer system, if the three-way valves 71, 73 are switched with the roller pump 2 placed in a driven state, circulation passageways are respectively formed by connection through the short-cut pipelines 61, 63 between the inlet pipelines 31, 33 and the outlet pipelines 41, 43 of the tubes 51, 53 to which the roller pump 2 is mounted. The liquid thus circulates through this circulation passageway so that no transfer is made to the transfer destinations 21, 23. If the flow passageway is switched over by the three-way valve 71, 73, the liquid in communication with each of the tubes 51, 53 is introduced from the transfer source 11, 13 to the transfer destination 21, 23.

During this period, stable supply or complete stoppage of liquid can be immediately established in accordance with the operation of the three-way valves 71, 73, due to continuous driving of the roller pump 2. It is therefore possible to suppress the delay of liquid transfer, the excess or deficiency in amount of the transfer, i.e., the deficiency in the amount of liquid transferred upon starting-up of the pump 2, and the excessive supply of liquid due to inertial rotation of the rotor 4 at stoppage, as compared with the conventional cases where transfer of fluid is controlled by driving and stopping a roller pump 2. To this end, the transfer timing and the transfer amount are accurately controlled by considering solely a slight responsive time accompanying the switching over of the three-way valves 71, 73.

In addition, it is possible to transfer liquid simultaneously to a plurality of transfer destinations and to control the transfer timing and the transfer amount of liquid, by mounting a plurality of tubes to a single roller pump 2. Therefore, installation of a plurality of roller pumps as conventionally done is not necessary.

Examples hereinbelow show other embodiments of switching means and structures for the fluid transfer system of the present invention.

Figure 6:
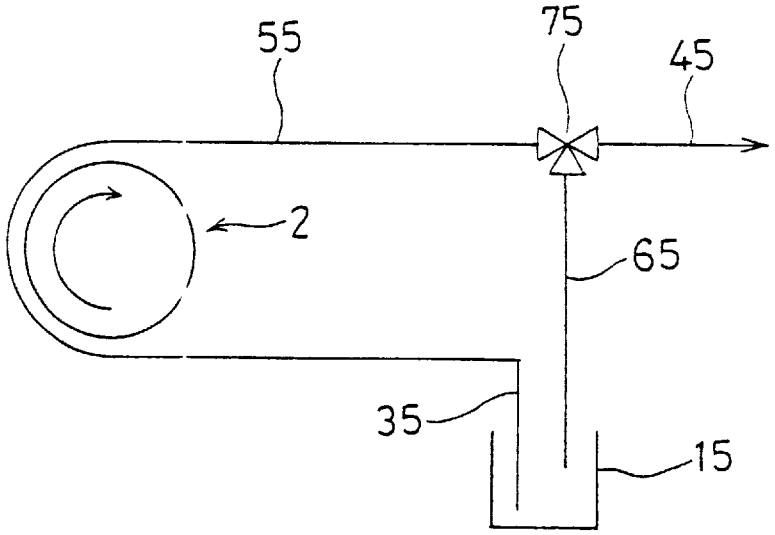
FIG. 6: A piping diagram of a fluid transfer system according to another embodiment of the present invention.

FIG. 6 shows a three-way valve 75 arranged on an outlet passageway of a tube 55, and a vent pipeline 65 branched at the three-way valve 75 and being open toward the inside of a liquid feed tank 15 as a transfer source.

When the roller pump 2 is driven and the three-way valve 75 is in an "off state", liquid is returned from the outlet passageway of the tube 55 via the three-way valve 75 and the vent pipeline 65 into the liquid feed tank 15. Consequently, no liquid is delivered to the pipeline 45. When the three-way valve 75 is switched over to an "on state", the liquid in the liquid feed tank 15 is transferred from the tube 55 to the transfer destination via the pipeline 45.

Figure 7:
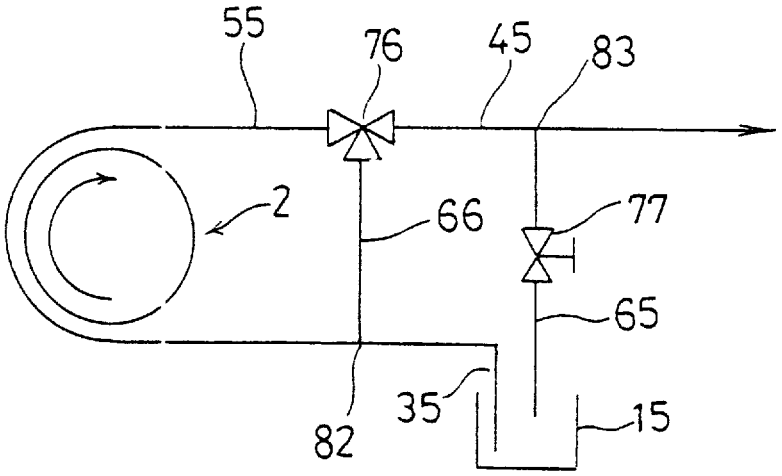
FIG. 7: A piping diagram of a fluid transfer system according to another embodiment of the present invention.

FIG. 7 shows a three-way valve 76 arranged at a branch point between an outlet passageway of a tube 55 and a short-cut pipeline 66, a vent pipeline 65 being open toward the inside of a liquid feed tank 15, and a flow-rate control valve 77 arranged in the vent pipeline 65.

When the roller pump 2 is driven and the three-way valve 76 is in an "off state", liquid circulates from the outlet passageway through the three-way valve 76, the short-cut pipeline 66, the branch point 82, and the tube 55, so that no liquid is delivered toward the pipeline 45. When the three-way valve 76 is switched over to an "on state", the liquid in the liquid feed tank 15 is distributed, depending on the opening degree of the flow-rate control valve 77, to the downstream of the pipeline 45 connected to the transfer destination and to the liquid feed tank 15. This offers adjustment of the amount of liquid to be transferred to the transfer destination.

Figure 8:
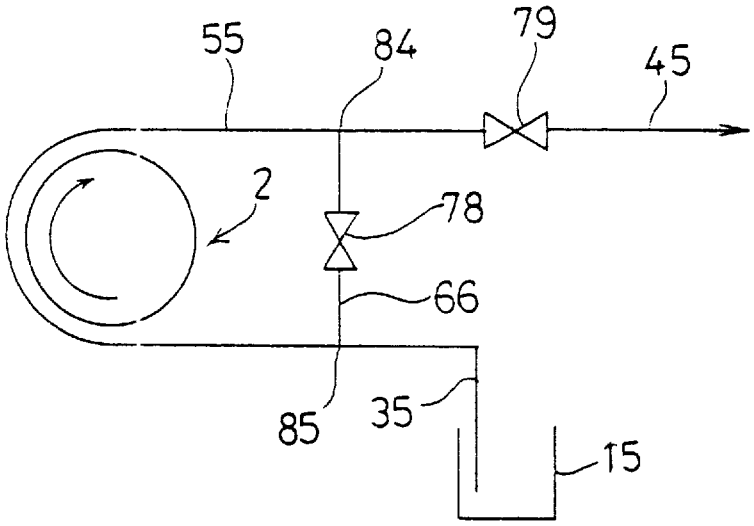
FIG. 8: A piping diagram of a fluid transfer system according to another embodiment of the present invention.

FIG. 8 shows a structure wherein a stop-valve 78 is provided in a short-cut pipeline 66 between an outlet passageway of the tube 55 and an inlet passageway thereof, and a stop-valve 79 is disposed in the pipeline 45, thereby opening and closing the stop-valve 79 in accordance with the closing and opening the stop-valve 78.

In a state in which the roller pump 2 is driven with the stop-valve 78 turned off the stop valve 79 turned on, liquid circulates from the outlet passageway through the branch point 84, the short-cut pipeline 66, the branch point 85, and the tube 55, so that no liquid is delivered toward the pipeline 45. When the two stop-valves 78, 79 are switched over, the liquid in the liquid feed tank 15 is transferred to the pipeline 45 via the tube 55.

Figure 9:
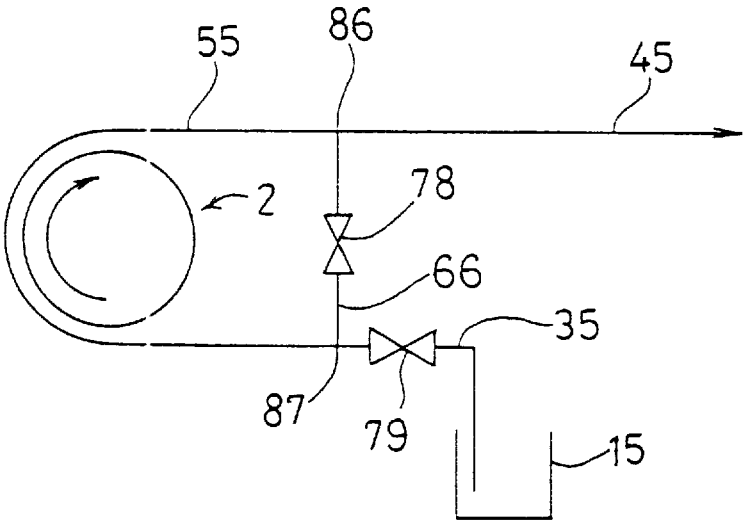
FIG. 9: A piping diagram of a fluid transfer system according to another embodiment of the present invention.
Figure 10:
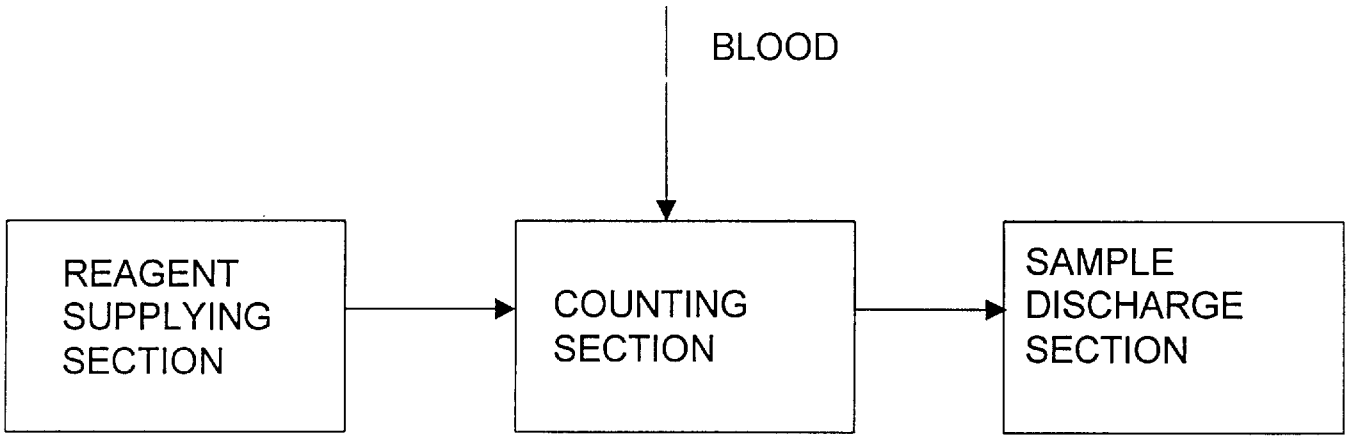
FIG. 10: A block diagram of a blood cell counter in which the invention is embodied.

FIG. 9 shows a structure wherein the stop-valve 79 provided in the pipeline 45 in FIG. 8 is disposed in a pipeline 35.

In a state in which the roller pump 2 is driven with the stop-valve 78 turned off and the stop-valve 79 turned on, the liquid circulates from the outlet passageway of the tube 55 through the branch point 86, the short-cut pipeline 66, the branch point 87, and the tube 55, so that no liquid is supplied to the pipeline 45. If the two stop-valves 78, 79 are switched over, the liquid in the liquid feed tank 15 is transferred to the pipeline 45 via the tube 55.

In this manner, according to each of the examples given above, the open-close control of the valves 71 to 79 while driving the roller pump 2 makes it possible to control the liquid transfer, tube by tube, from the transfer source positioned on the inlet side of the each of the tubes 51 to 55 toward the transfer destination. Consequently, one roller pump is satisfactory for installation, significantly reducing installation space. Furthermore, since the passageway switching means is controlled to open and close while driving the roller pump 2, there is less possibility of excess or deficiency of liquid transferred upon driving and stoppage of the motor 3 for the pump 2, offering accurate control of the timing and the amount of transfer.

Furthermore, by disposing a three-way valve 76 at the branch point between the inlet passageway of the tube 5 and the short-cut passageway 66, the vent flow passageway 67 branched from the pipeline 45 on the downstream of the three-way valve 76 and being open into the liquid feed tank 15, three-way valve 76, and the flow-rate control valve 77 disposed in the vent flow passageway 67, the liquid transferred to the pipeline 45 is distributed at the branch point 83 depending on the opening degree of the flow-rate control valve 77 so that the transfer amount through the pipeline 45 toward the transfer destination can be adjusted.

In the fluid transfer system of the present invention, when the roller pump is driven, the rotation of the roller squeezes the tube so that the liquid in communication with the tube is introduced from a transfer source to a transfer destination. If the passageway switching means is switched over while the roller pump is being driven, a circulating flow passageway is formed by communication through the short-cut passageway between the inlet and outlet passageways for the roller pump so that the fluid is placed in circulation through the circulating flow passageway without being transferred to the transfer destination. During this period, the roller pump continues to be driven and the fluid is promptly brought into circulation through the circulating flow passageway, immediately and completely suspending the fluid transfer to the transfer destination. Therefore, the delay in stoppage of the fluid and the excess of transfer amount thereof can be suppressed to a minimum, as compared with the case where the fluid transfer is suspended by stopping the pump motor as conventionally done.

If the passageway switching means is switched over again, the fluid in communication with the tube is introduced from the transfer source to the transfer destination. During this period, the roller pump continues to be driven and the fluid circulating through the circulating flow passageway responds to the switching operation of the flow passageway and immediately placed in transfer toward the transfer destination, thereby starting stable supply of fluid without delay. Therefore, the delay in starting the fluid transfer and the deficiency of transfer amount can be suppressed to a minimum, as compared with the case where the fluid transfer is suspended by starting the pump motor as conventionally done.

If a plurality of tubes are fitted onto one roller pump, each of the tubes having a short-cut passageway and a passageway switching means provided therein, and the passageway switching means being simultaneously or individually switchable, then it is possible to simultaneously transfer fluid to a plurality of transfer destinations with one roller and to control the transfer timing and the amount of liquid to be transferred tube by tube.

If the passageway switching means is provided at a branch point between the short-cut passageway and either of an inlet passageway and an outlet passageway of the tube fitted onto the roller pump, the flow passageway means being a three-way switching valve which is capable of assuming a state in which fluid is allowed to return from the outlet passageway through the short-cut passageway to the inlet passageway by opening the short-cut passageway and a state in which the fluid introduced into the inlet passageway is allowed to flow from the outlet passageway toward a transfer destination by closing the short-cut passageway, then simplification is achieved in the structure of piping including the switching means and control of switching means.

If the short-cut passageway is a vent flow passageway connecting between the outlet passageway and a transfer destination, and the passageway switching means is a three-way switching valve provided at a branch point between the outlet passageway and the vent flow passageway, then the structure of piping is simplified. Also, a circulation passageway is formed including the transfer source as part of the flow passageway, and the circulation passageway can be formed as an open system, so that if the transfer source includes a reservoir or a tank (vessel), the fluid in the transfer source can be stirred by the circulation flow.

The present invention provides a fluid transfer system which is capable of constant-amount transfer with accuracy and precision. Also, even where a plurality of tubes are fitted onto one roller, it is possible to provide a fluid transfer system which can control the fluid transfer tube by tube.

What is claimed is:

1. A fluid transfer system employing a roller pump for squeezing an elastically deformable tube by a roller to allow fluid to be transferred from a transfer source through an inlet passageway to the tube and from the tube through an outlet passageway to a transfer destination, said fluid transfer system comprising:

a short-cut passageway connecting the inlet passageway and the outlet passageway of said tube fitted onto said roller pump;

a passageway switching means for controlling communication of the pumped fluid into the short-cut passageway to selectively switch between a first state permitting transfer of the fluid to the transfer destination and a second state forbidding transfer of the fluid to the transfer destination;

said first state being a state in which the inlet passageway and the outlet passageway are not in fluid communication with each other through the short-cut passageway, and, said second state being a state in which the inlet passageway and the outlet passageway are in fluid communication with each other through the short-cut passageway, thereby directing circulation of the fluid through said tube and said short-cut passageway.

2. A fluid transfer system according to claim 1, wherein a plurality of tubes are fitted onto one roller pump, each of said tubes having a short-cut passageway and a passageway switching means provided therein, and each of said passageway switching means being simultaneously or individually switchable.

3. A fluid transfer system according to claim 1, wherein 4 to 6 tubes are fitted onto the roller pump.

4. A fluid transfer system according to any one of claims 1 to 3, wherein said passageway switching means is provided at a branch point between said short-cut passageway and either of an inlet passageway and an outlet passageway of said tube fitted onto said roller pump passageway, said passageway switching means being a three-way switching valve which is capable of assuming a state in which the fluid is allowed to return from said outlet passageway through the short-cut passageway to said inlet passageway by opening said short-cut passageway and a state in which the fluid introduced into said inlet passageway is allowed to flow from said outlet passageway toward a transfer destination by closing said short-cut passageway.

5. A fluid transfer system according to any one of claims 1 to 3, wherein said passageway switching means comprises two stop-valves, one being disposed in the short-cut passageway and the other being disposed in the inlet passageway closer to the transfer source relative to a branch point.

6. A fluid transfer system according to any one of claims 1 to 3, wherein said passageway switching means comprises two stop-valves, one being disposed in the short-cut passageway and the other being disposed in the outlet passageway closer to the transfer destination relative to a branch point.

7. A fluid transfer system according to any one of claims 1 to 3, wherein said short-cut passageway is a vent flow passageway connecting between said outlet passageway and said transfer source, and said passageway switching means is a three-way switching valve provided at a branch point between said outlet passageway and said vent flow passageway.

8. A blood cell counter having a reagent-supplying section, a counting section for preparing a sample to be measured by adding a reagent transferred from said reagent-supplying section into a blood sample to count the number of blood cells in the sample to be measured, and a sample-discharging section for discharging the sample measured by said counting section, wherein said reagent-supplying section or said sample discharging section comprises said fluid transfer system recited in claim 1 or 2.

* * * * *